US007315691B1

(12) United States Patent
Palkie et al.

(10) Patent No.: US 7,315,691 B1
(45) Date of Patent: Jan. 1, 2008

(54) WAX DISPENSER FOR HOT WAX APPLICATIONS

(75) Inventors: Mia Palkie, Salt Lake City, UT (US); Megan Palkie, Ventura, CA (US)

(73) Assignee: Wax Figures, Inc., Salt Lake City, UT (US)

( * ) Notice: Subject to any disclaimer, the term of this patent is extended or adjusted under 35 U.S.C. 154(b) by 747 days.

(21) Appl. No.: 10/758,141

(22) Filed: Jan. 15, 2004

(51) Int. Cl.
*A47J 27/00* (2006.01)

(52) U.S. Cl. ..... 392/441; 392/459; 222/146.5

(58) Field of Classification Search ..... None
See application file for complete search history.

(56) References Cited

U.S. PATENT DOCUMENTS

| | | | | |
|---|---|---|---|---|
| 1,007,188 | A | 10/1911 | Dickson | |
| 1,328,769 | A | 1/1920 | Spencer | |
| 1,381,500 | A | 6/1921 | Reader | |
| 1,393,263 | A | 10/1921 | Clifton | |
| 1,394,662 | A | 10/1921 | Blomquist | |
| 1,815,589 | A | 7/1931 | Saachy | |
| 2,118,415 | A | 5/1938 | Pesark | |
| 3,598,282 | A | 8/1971 | Phillips | 222/146 HE |
| 3,864,045 | A | 2/1975 | Hudson | 401/1 |
| 3,876,105 | A * | 4/1975 | Kelling | 222/56 |
| 4,282,877 | A | 8/1981 | Mathews | 128/355 |
| 4,395,968 | A * | 8/1983 | Wahnschaff et al. | 118/602 |
| 4,499,367 | A | 2/1985 | Schwob | 219/421 |
| 4,505,669 | A * | 3/1985 | Rogers | 432/13 |
| 4,641,764 | A * | 2/1987 | Faulkner, III | 222/146.2 |
| 4,771,920 | A * | 9/1988 | Boccagno et al. | 222/146.5 |
| 4,773,784 | A | 9/1988 | Mann | 401/1 |
| 4,842,610 | A | 6/1989 | Gordon et al. | 8/160 |
| 4,850,425 | A * | 7/1989 | Anderson | 165/65 |
| 4,958,951 | A | 9/1990 | Mann | 401/1 |
| 5,123,569 | A * | 6/1992 | Lindner | 222/56 |
| D333,883 | S | 3/1993 | Mann | D28/10 |
| 5,333,382 | A | 8/1994 | Buchbinder | 30/47 |
| 5,395,175 | A | 3/1995 | Bontoux et al. | 401/1 |
| 5,470,332 | A | 11/1995 | Mehl, Sr. et al. | 606/36 |
| 5,523,537 | A * | 6/1996 | Johannes et al. | 219/421 |
| 5,725,847 | A | 3/1998 | De La Mettre et al. | 424/70.1 |
| 5,803,636 | A | 9/1998 | Legrain et al. | 401/1 |
| 5,847,363 | A | 12/1998 | Debourg et al. | 219/424 |
| 5,908,425 | A | 6/1999 | Adam | 606/133 |
| 5,980,536 | A | 11/1999 | Jamali | 606/134 |
| 5,997,889 | A | 12/1999 | Durr et al. | 424/401 |
| 6,039,482 | A | 3/2000 | Smal | 401/1 |
| 6,053,649 | A * | 4/2000 | Ronai | 401/1 |
| 6,063,076 | A | 5/2000 | Mehl, Sr. et al. | 606/36 |
| 6,074,385 | A | 6/2000 | Klopotik | 606/27 |
| 6,080,127 | A | 6/2000 | Li et al. | 604/22 |
| 6,084,211 | A | 7/2000 | Bauer | 219/242 |

(Continued)

FOREIGN PATENT DOCUMENTS

| | | |
|---|---|---|
| FR | 2517940 | 12/1981 |

*Primary Examiner*—Thor Campbell
(74) *Attorney, Agent, or Firm*—Snell & Wilmer L.L.P.

(57) ABSTRACT

A hot wax dispensing device designed to minimize the risk of cross contamination caused by "double dipping" into a community hot wax pot. This device receives bulk wax, melts the wax, allows the melted hot wax to collect in a bowl that is not directly accessible by a user. Hot wax is then dispensed in single client portions in a disposable insert for use in depilatory waxing.

16 Claims, 6 Drawing Sheets

U.S. PATENT DOCUMENTS 6,107,352 A 8/2000 Zofchak et al. ..... 516/914
6,146,620 A 11/2000 Janowski ..... 424/73
6,327,779 B1 12/2001 Skipper ..... 30/74
6,463,661 B2 10/2002 Skipper ..... 30/74
6,639,190 B2 10/2003 Lerner ..... 219/445.1
6,935,535 B2 * 8/2005 Pandolfi et al. ..... 222/146.5

* cited by examiner

WAX DISPENSER FOR HOT WAX APPLICATIONS

BACKGROUND OF INVENTION

1. Field of the Invention

This invention relates to devices for heating and dispensing hot wax. More specifically, this invention relates to hot wax dispensers that improves the cleanliness and helps prevent the spread of infectious diseases.

2. Description of the Related Art

A variety of techniques are well known for use in dispensing hot wax in the hair removal process, otherwise known as depilatory waxing. Generally, these prior techniques fail to address the significant risk of spread of infectious diseases caused by cross-contamination between customers by repeated use of an applicator stick and/or use of the same portion of wax for more than one customer.

Although these references may not necessarily be prior art to the present invention, the reader is referred to the following U.S. patent documents for general background material. Each of these patents is hereby incorporated by reference in its entirety for the material contained therein.

U.S. Pat. No. 1,007,188 describes a wax melter.

U.S. Pat. No. 1,328,769 describes a sealing wax applier.

U.S. Pat. No. 1,381,500 describes an electric wax heater.

U.S. Pat. No. 1,393,263 describes a wax melting machine and a seal maker.

U.S. Pat. No. 1,394,662 describes a floor waxing and polishing device.

U.S. Pat. No. 1,815,589 describes a batik wax lining tool.

U.S. Pat. No. 2,118,415 describes a device for applying sealing wax.

U.S. Pat. No. 3,598,282 describes an apparatus for melting solidified material and feeding the resultant liquid.

U.S. Pat. No. 3,864,045 describes a waxing tool having a body portion with a reservoir for holding wax and a handle pivotally connected to the body portion.

U.S. Pat. No. 4,282,877 describes a hair removing arrangement.

U.S. Pat. No. 4,499,367 describes a device and method for wax depilation, where a drawing recipient is borne by a body associated with a heating means.

U.S. Pat. No. 4,773,784 describes a system for heating and applying a depilatory wax to skin for removal of hair.

U.S. Pat. No. 4,842,610 describes depilatory compositions and methods.

U.S. Pat. No. 4,958,951 describes a hot wax hair remover apparatus that includes a reservoir, which stores a supply of the wax and a dispenser coupled to the reservoir.

U.S. Pat. No. 5,333,382 describes a brow shaver that includes a handle portion and a blade complex portion.

U.S. Pat. No. 5,395,175 describes a dispenser for dispensing a thermoplastic produce in a fluid state.

U.S. Pat. No. 5,470,332 describes a multiple hair removal system that includes an adhesive layer, a structural layer disposed adjacent the adhesive layer and a conductive material.

U.S. Pat. No. 5,725,847 describes a hair-removing composition.

U.S. Pat. No. 5,803,636 describes an applicator for a thermoplastic product.

U.S. Pat. No. 5,847,363 describes a hair removal wax device that comprises at least one tank linked to a heating means and a detachable instrument, independent from the tank.

U.S. Pat. No. 5,908,425 describes a method and apparatus for hair removal.

U.S. Pat. No. 5,980,536 describes a wax container and applicator kit that includes a cylindrical container having an open top portion.

U.S. Pat. No. 5,997,889 describes compositions for hand and body creme made of substantially naturally occurring ingredients.

U.S. Pat. No. 6,039,482 describes a hot wax remover apparatus comprising a heating sleeve.

U.S. Pat. No. 6,063,076 describes a method and system for removal of hair with a conductive layer, including a conductive material.

U.S. Pat. No. 6,074,385 describes an apparatus, methods, materials and systems for devitalizing hair follicles.

U.S. Pat. No. 6,080,127 describes a skin vibration method for topical targeted delivery of beneficial agents into hair follicles.

U.S. Pat. No. 6,084,211 describes a device for heating hairdressing scissors.

U.S. Pat. No. 6,107,352 describes chemical compositions used in cosmetic, personal care and household products.

U.S. Pat. No. 6,146,620 describes compositions useful in altering the growth of male beard hair.

U.S. Pat. No. 6,327,779 B1 and U.S. Pat. No. 6,463,661 B2 describe magnetic shaving systems.

U.S. Pat. No. 6,639,190 B2 describes a heat alert safety device for smooth top stoves and other hot surfaces.

U.S. Pat. No. Des. 333.883 describes the ornamental design for a hot wax hair remover apparatus.

SUMMARY OF INVENTION

It is desirable to provide a device designed to melt and dispense wax for use in the hair removal process, otherwise known as depilatory waxing. It is particularly desirable to provide such a wax-dispensing device that, if used correctly, will improve the cleanliness of the waxing process and will help reduce the spread of infectious diseases. Moreover, it is desirable that the wax-dispensing device be compatible with standard depilatory wax and that its use not significantly disturb the esthetician's depilatory waxing routine.

Accordingly, it is an object of this invention to provide a device, which melts and dispenses wax for use in depilatory waxing.

It is a further object of this invention to provide a wax-dispensing device that provides a fresh portion of melted wax for each customer.

A still further object of this invention is to provide a wax-dispensing device that melts the wax in a separate heated reservoir.

It is a still further object of this invention to provide a wax-dispensing device that heats the wax in an area that cannot be directly accessed by a user with an applicator stick.

Another object of this invention is to provide a wax-dispensing device that dispenses the melted wax into a disposable cup for application for each customer.

A still further object of this invention is to provide a wax-dispensing device that avoids "double dipping" where an application stick is repeatedly dipped into the hot wax, which is used for multiple customers.

Additional objects, advantages and other novel features of this invention will be set forth in part in the description that follows and in part will become apparent to those of ordinary skill in the art upon examination of the following description and drawings or may be learned with the practice of the invention. The objects and advantages of this invention may be realized and attained by means of the instrumentalities and combinations particularly pointed out in the appended claims. Still other objects of the present invention will become readily apparent to those skilled in the art from the following description wherein there is shown and described present preferred embodiments of the invention, simply by way of illustration of modes known to the inventor to carry out this invention. As it will be realized, this invention is capable of other different embodiments, and its several details, and specific components. Such modifications can be made without departing from the concept of this invention. Accordingly, these objects, summary, drawings and descriptions should be regarded as illustrative and not as restrictive.

BRIEF DESCRIPTION OF DRAWINGS

The accompanying drawings incorporated in and forming a part of the specification, illustrate the present preferred embodiment of the invention. Some, although not all alternative embodiments are described in the following description. In the drawings.

Figure 1:
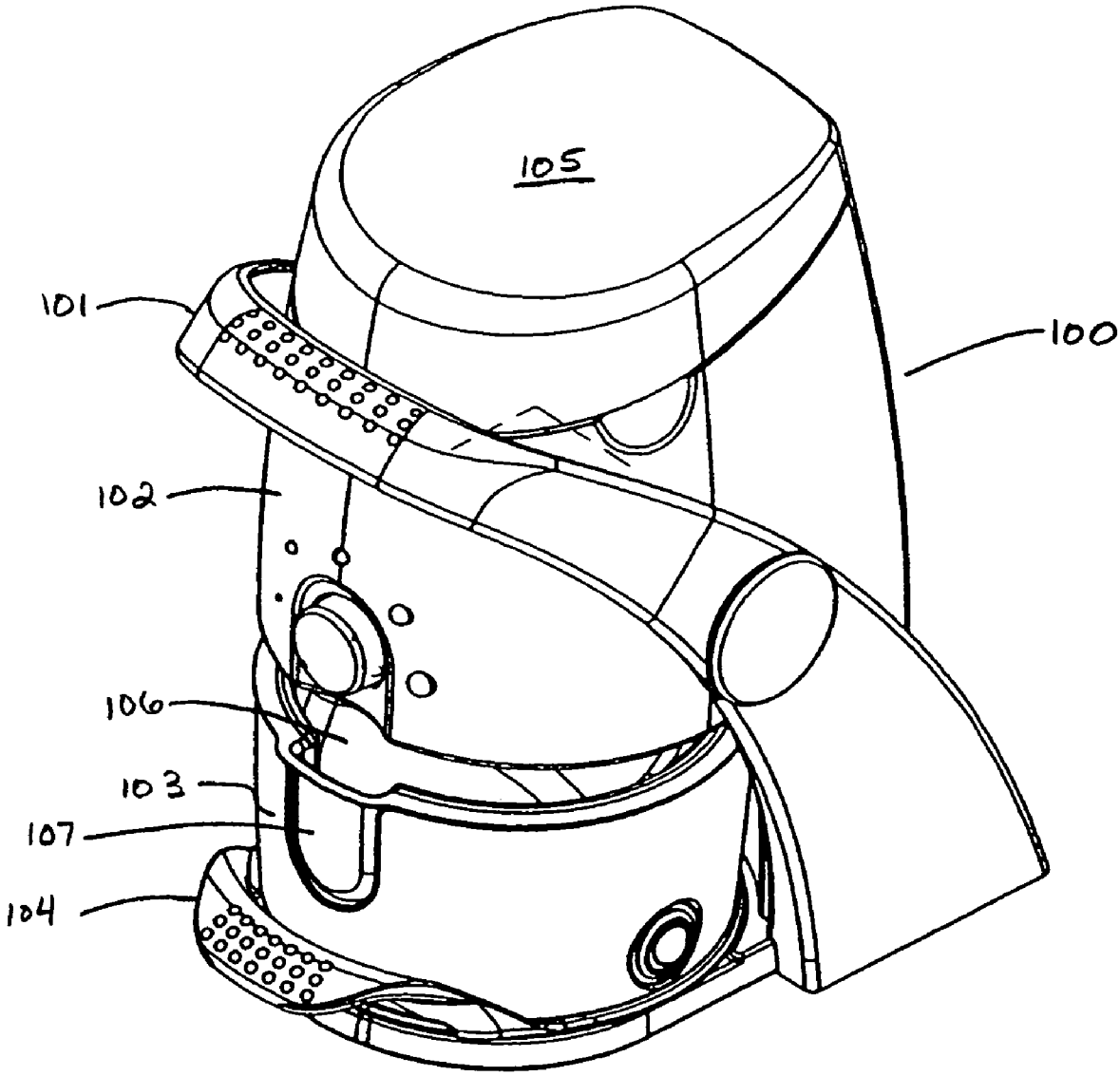
FIG. 1 is a perspective view of the present embodiment of the wax dispenser of this invention.

Reference will now be made in detail of the present preferred embodiment of the invention, an example of which is illustrated in the accompanying drawings.

DETAILED DESCRIPTION

This invention, referred to herein as a wax dispenser, is a device for melting and dispensing wax for use in the hair removal process, otherwise known as depilatory waxing. This wax dispenser is designed to provide a portion of hot wax, of selectable quantity, for each individual client, thereby minimizing the risk of client-to-client cross contamination.

Prior to this invention a typical depilatory waxing procedure involved heating a significant quantity of wax to a temperature of between 120° F. to 140° F. in a pot similar to a crock-pot. The amount of hot wax that is thus prepared is generally sufficient for a number of clients and in kept in a communal pot, where it is kept sufficiently hot to remain melted. A wooden stick (similar to a tongue depressor or a Popsicle stick) is dipped into the hot wax and applied to the client's skin. Although illegal in many jurisdictions and certainly not best practice, it is a common practice to use and resuse the same stick for second, third and continuous applications, until the desired areas of the client's body are free of hair. This process is referred to in the trade as "double dipping." While the esthetician may not reuse a stick with multiple clients, the process of "double dipping" serves to transfer from the client hair and in some instances fluids from the clients back to the communal pot. Since hot wax is an excellent breading and/or maintenance ground for germs and viruses, the "double dipping" technique common in the trade have been shown to increase the likelihood of cross-contamination of serious infections diseases and maladies. A variety of approaches have been proposed to deal with this cross contamination problem. The most common of which is use of roll-on waxing systems. However, this roll-on approach has been unsuccessful at solving this problem because (1) it allows wax that has touched a client's body to re-enter the roller head thereby contaminating other wax; (2) it is inconvenient because it changes the esthetician's routine and dictates the type or brand of wax that can be used; and (3) it is expensive compared to the more traditional stick application approach. Attempts by esthetician's to control costs have led some estheticians to reuse roller heads for multiple clients, thereby exasperating the cross contamination problem.

This hot wax dispenser addresses this problem directly. Cross contamination is eliminated by eliminating access to the communal pot of wax. Each client receives wax from a disposable cup containing only wax for their use. The esthetician may double dip into the client's disposable cup because, so long as a new disposable liner is used for each client, there is no risk of contaminating the wax used for subsequent clients. This wax dispenser does not require the esthetician to change their routine in any significant manner. It does, however, avoid cross contamination further by eliminating access to the wax to be used for subsequent clients. This wax dispenser is designed and adapted to accommodate most if not all types and brands of depilatory wax, whether in bead, brick or can form. Again, one of the most important features of this invention is that it provides an individual client sized disposable cup of wax, while removing access to the heated reservoir of hot wax used for subsequent clients, and thereby minimizing the cross-contamination problem caused by "double dipping" in depilatory waxing.

FIG. 1 shows a perspective view of the present embodiment of the wax dispenser 100 of this invention. A body portion 102 is provided, within which is the wax retainer, the heater assembly and the dispensing assembly. A handle 101 is provided for activating the dispensing assembly, thereby releasing melted wax to the cup 103 with its insert 106. A cup handle 104 is provided to facilitate extraction of the cup 103. Although the cup 103 is generally not removed during operation and wax can be dispensed with the cup 103 in either the in or the out position. In either situation, the insert 106 preferably stays in the heated area of the cup 103. A window 107 is provided in the cup 103 to permit a user to see the wax as it flows into the cup 103 or its insert 106 and to insure that the cup 103 does not hold wax without an insert 106 in place. A lid 105 is provided to allow access to the wax retainer. It is worth noting, however, that the lid does not provide access to melted hot wax because the wax in the retainer as it melts flows through a grate to a reservoir or bulk-heating bowl within the body portion 102. The grate insures that a user cannot reach hot melted wax in the bulk-heating bowl through the lid. These internal components are shown in more detail proximate to their assembly in FIGS. 4 and 5.

Figure 2:
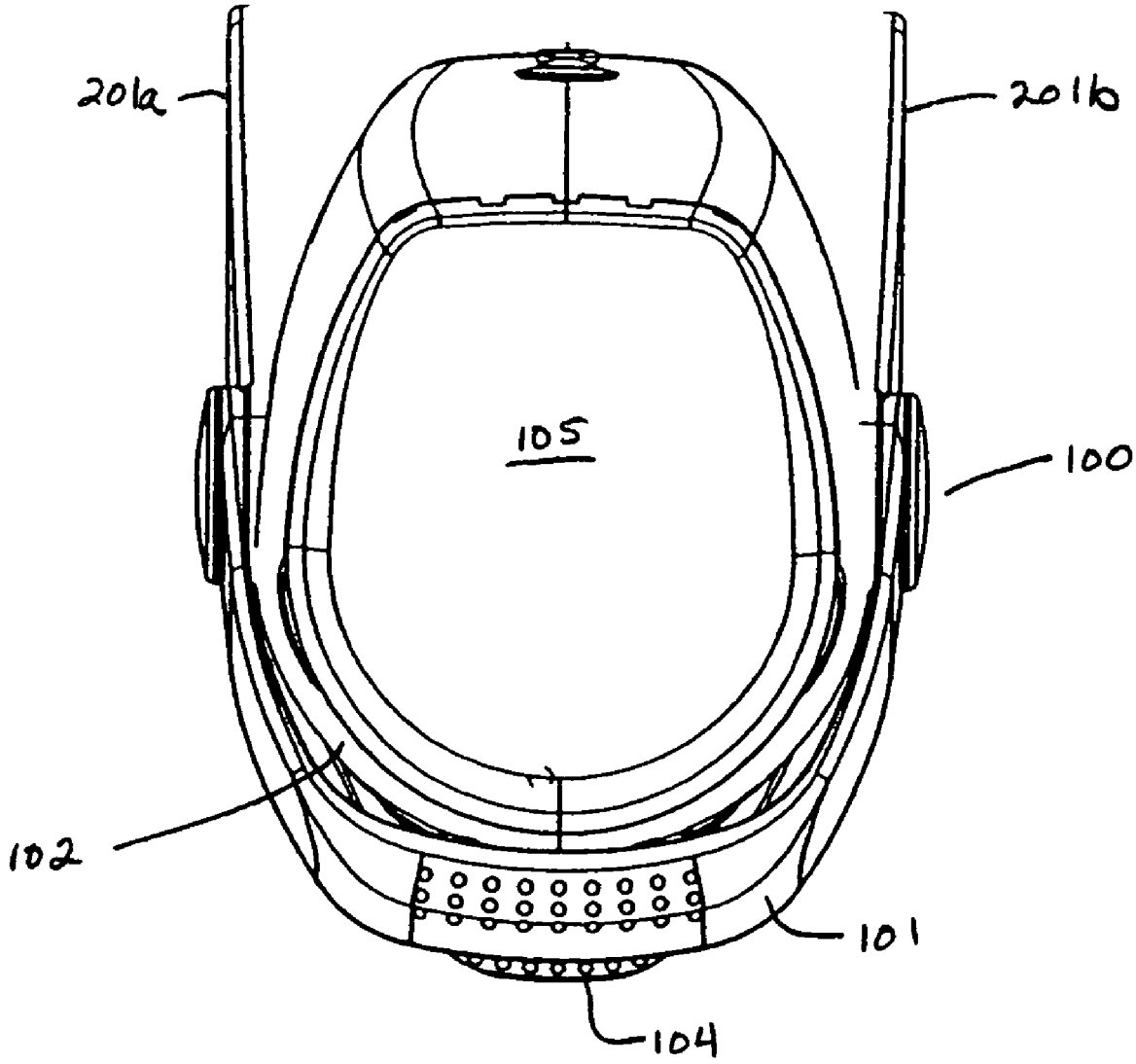
FIG. 2 is a top view of the present embodiment of the wax dispenser of this invention.
Figure 3:
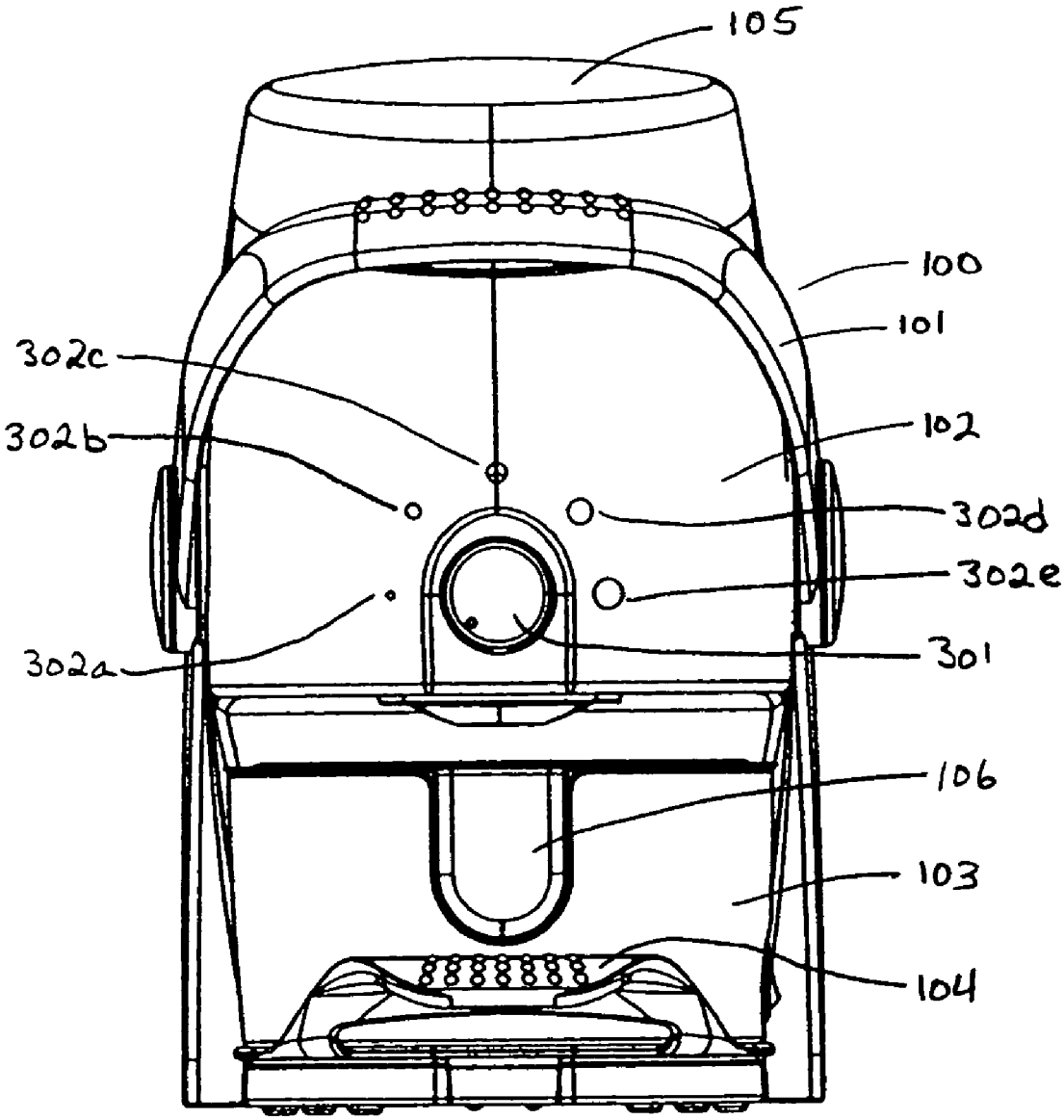
FIG. 3 is a front view of the present embodiment of the wax dispenser of this invention.

FIG. 2 shows a top view of the present embodiment of the wax dispenser 100 of this invention. This view shows the wax dispenser 100 with the support legs 201*a,b* attached to the body portion 102, as an extension of the handle 101. FIG. 3 shows a front view of the present embodiment of the wax dispenser 100 of this invention. This view provides additional detail of the heat selection knob 301 and its various setting locations 302*a,b,c,d,e*, which in the present embodiment are used as a visual guide to a smooth turn heat selection knob, on the front of the body portion 102. In the present embodiment, by adjusting the knob in a clock-wise direction the temperature of the wax in the bulk heating bowl is increased.

Figure 4:
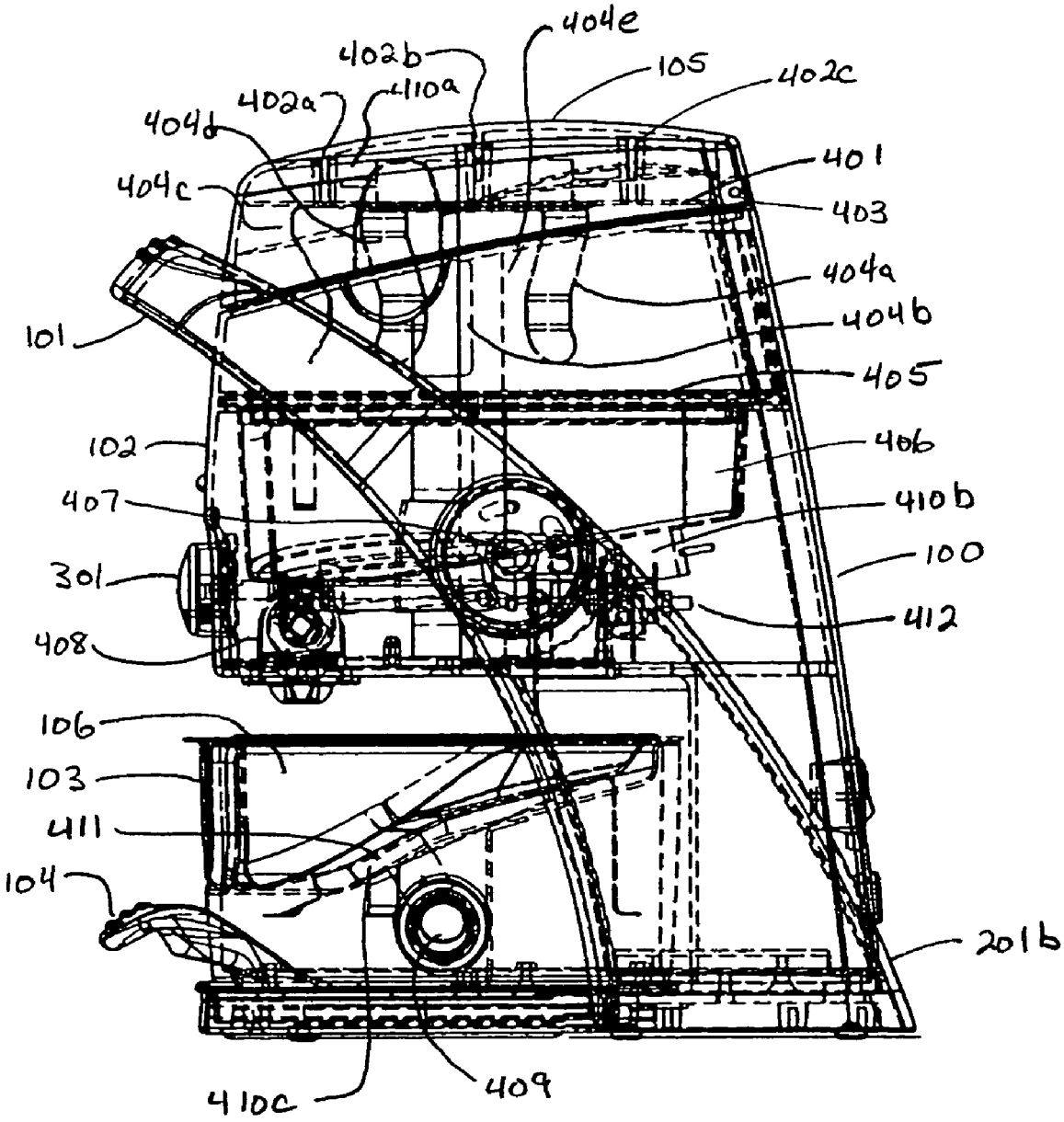
FIG. 4 is a side/section view of the present embodiment of the wax dispenser of this invention.
Figure 5:
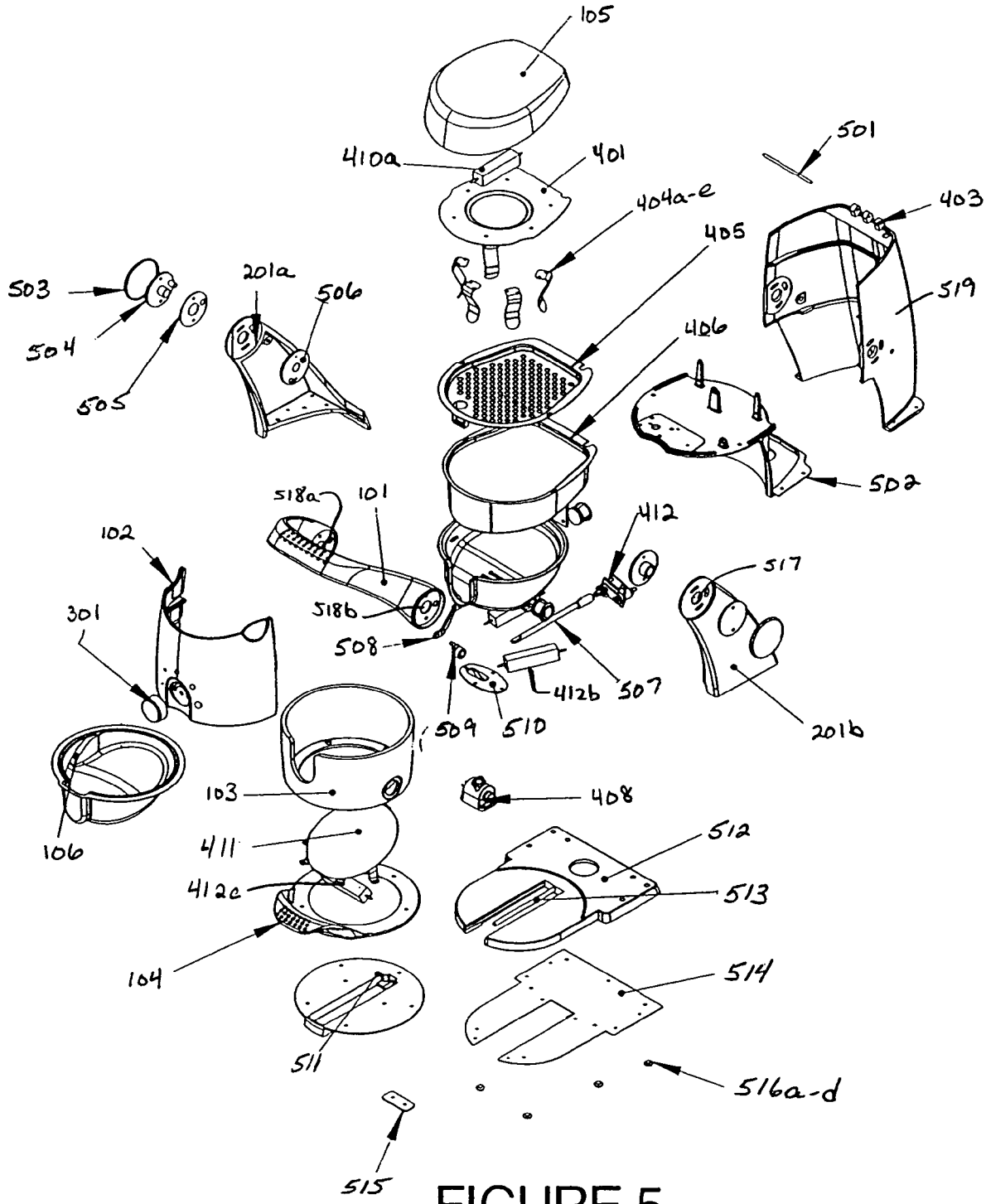
FIG. 5 is a detailed component assembly view of the present embodiment of the wax dispenser of this invention.

FIG. 4 shows a side/section view of the present embodiment of the wax dispenser 100 of this invention. This view is a section view taken from the side to show the various components in a fully assembled configuration. Under the lid 105 is heat conducting plate 401. The can or other receptacle holding the wax is positioned upside-down on the grate 405. The heat conducting plate 401 is a metal plate which conducts heat from the heater 410*a* in the lid 105 to the wax containing can. As the wax melts it flows through the grate 405. While in the present embodiment the wax is provided in a can, in alternative embodiments, the wax may be simply placed on the grate directly. The wax may be in the form of a brick, beads or the like. In the present embodiment, the heat conducting plate 401 is fixed to the lid 105 by a number of screws 402*a,b,c* so that with the lid 105 flipped open on its hinge 403 the heat conducting plate 401 can receive a can or other bulk wax holding receptacle. When the lid 105 is closed the top of the can is then reversed so that the melted wax will flow freely out of the can down into the interior of the body portion 102. Attached to the heat conducting plate 401 can be a number of spring clips 404*a–e* for frictionally holding the can in place. In one present alternative embodiment these spring clips 404*a–e* are not provided and the was or wax container simply rests directly on the grate 405. Immediately below the clips 404*a–c* and the can when placed below the heat conducting plate 401 is the grate 405. The grate 405 is provided with a number of openings, as shown in FIG. 5, sufficient to allow the melted wax to flow through the grate 405 to the bulk heating bowl 406 below the grate 405. A valve 408 is attached to the bottom of the bulk-heating bowl 406 is connected 407 to the handle 101. When the handle 101 is pressed, the interior of the valve is turned permitted the melted wax to flow through a valve 408 to the insert 106 in the cup 103. By pulling on the cup handle 104, the cup 103 assembly 409 is brought forward permitting the user to remove the insert 106, now containing hot wax for use on a single client. The cup 103 assembly 409 can be in either the in or the out position when dispensing wax. The insert 106 stays in the heated area of the cup 103 while the client is being waxed. The insert 106 is disposed of once the client waxing is completed. Typically, although not necessarily, the client waxing is performed with the cup 103 in an out position and the insert 106 still in the cup 103. Several heating elements 410*a,b,c* are provided. A first heating element 410*a* is located above the heat conducting plate 401. Since, typically the heat conducting plate 401 and the clips 402*a–e*, if used, are made of good heat conducting metal, the heat from this first heating element 410*a* is conducted to the can containing the bulk wax for melting this wax. A second heating element 410*b* is located under the under the bulk heating bowl 406 for keeping the melted wax in a liquid state. A third heating element 410*c* is located under the cup plate 411, which supports the cup 103, for keeping the dispensed wax in the disposable insert melted. Each of the heating elements 110*a,b,c* controlled by the selection knob 301, limited by a thermostatic switch 412 provided to avoid overheating for safety purposes.

FIG. 5 shows a detailed component assembly view of the present embodiment of the wax dispenser 100 of this invention. Each of these components shown is typically assembled as shown using small screws, bolts, pins and the like. The cup 103 is presently made of abs plastic. In its present embodiment is approximately 3 inches in height and 5.5 inches in diameter and has five screw holes for fixing the cup 103 to the cup plate 411. The insert 106 is sized to fit within the cup 103 and is approximately 5.2 inches in diameter and 1.9 inches at it highest point. Presently the insert 106 is made of thermormed tinted clear polycarbonate. The cup handle 104 is presently made of plastic, although in alternative embodiments cast aluminum or similar material can be substituted without departing from the concept of this invention, and is 5.75 inches in diameter with a grip portion height of approximately 1.1 inches. The cup handle 104 is provided with five screw holes for assembly. The bulk-heating bowl 406 is presently made of aluminum and is approximately 5.6 inches in width, 6.2 inches in length and 2.2 inches in height. The bulk-heating bowl 406 is provided with an opening (not shown) on the bottom toward the front for release of melted wax. The valve 408 is presently cast brass with an internal rotatable portion having an opening which when aligned with the inlet port allows the melted wax to flow from the opening in the bulk heating bowl 406 through the valve inlet, through the internal rotatable portion to the valve outlet and to the insert 106. Four screw holes are provides for assembly. The support legs 201*a,b* are presently made of case aluminum and are approximately 6 inches in height and 3.2 inches in width. Screw holes are provided for assembly and an opening 517 is provided for mounting the handle 101. A switch link shaft, presently made of aluminum, 507 connects the knob 301 to the thermostat 412*b*. The handle 101 is presently made of case aluminum and is provided with a hole 518*a,b* on each end for connection to the support legs 201*a,b*. Typically, a spring is linked to the handle 101 to keep the valve in a normally closed position. The lid 105 is presently made of abs plastic and is approximately 5.5 inches in width and 6.5 inches in length. The lid 105 is provided with six screw holes for assembly. A valve-coupling lever 509, presently made of aluminum is provided for connecting valve 408 to the valve linkage 508. The valve linkage 508 is presently made of 12 gage steel. A wax nozzle 510 is provided presently in abs plastic to provide hot wax flow control. A handle cap 503 is provided for each end of the handle 101. Presently the handle cap is made of cast aluminum. The base body portion 102 is presently made of abs plastic and is adapted to fit about the front upper part of the wax dispenser 100. The base 502 provides the support structure for the bulk-heating bowl 406. The base 502 is presently made of abs plastic and has a number of screw holes for assembly purposes. The rear portion 519 is presently made of abs plastic and is fitted with the hinge 403, which with a hinge pin 501, presently a 0.125 diameter steel rod, secures the lid 105. Holes in the sides of the rear portion 519 are adapted to receive the connection to the ends of the arm 101. Screw holes in the rear portion 519 provide the means with screws of attaching the rear portion to the base 502. An outer handle axle 504 is provided for each end of the handle 101 and is presently made of abs plastic. An inner axle handle 506 is provided for each end of the handle 101 and is presently made of abs plastic. A washer 505 is provided for each handle axle, presently made of nylon. The grate 405 is presently made of aluminum and is provided with a number of 0.25-inch holes and a single 0.625-inch diameter hole. The clips 404*a–e*, although not necessary for the present embodiment, can be made of 24-gage steel. The heat conducting plate 401 is presently made of 18-gage steel and is provided with six screw holes for assembly. The knob 301 is presently made of abs plastic and is adapted to receive the link shaft 507. A base extension 512, presently made of cast aluminum, is provides with six screw holes and nine feet holes. A cup housing bottom 511, presently made of cast aluminum, is adapted for supporting the cup assembly 411 and is provides with seven screw holes for assembly purposes. A cup slider tab 515, presently made of 13-gage steel, is provided to fit in the cup-housing bottom. The cup plate 411, presently made of 24-gage steel is provides with five mounting fixtures for fastening in place. A base cover 514 made of 18-gage steel is provided with screw and foot holes. The electrical wire (not shown) connecting AC power to the resistor heaters 412*a,b,c* and carrying control signals from the thermostatic switches are held within a stainless steel tube.

Figure 6:
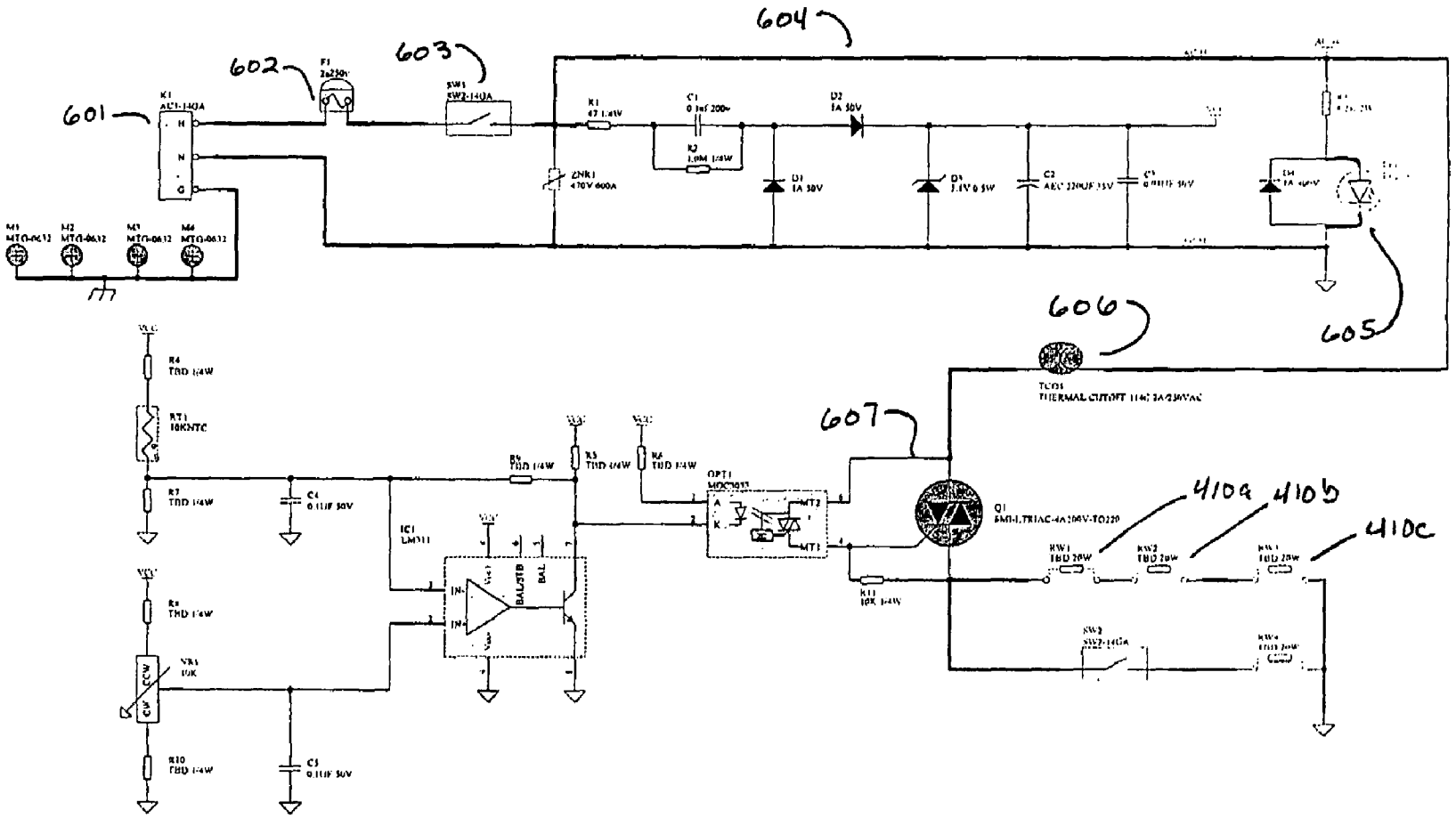
FIG. 6 is the electrical wiring diagram for the present embodiment of this invention.

FIG. 6 shows the electrical wiring diagram of the wax dispenser 100 of this invention. This diagram shows the power connection 601, fuse 602 and switch 603 in series with a power smoothing circuit 604 and a power indicator LED 605. A thermal cutout 606 is provided in series with the drive circuit 607 for the heating element resistors 410*a,b,c*.

It is to be understood that the above-described embodiments and examples are merely illustrative of numerous and varied other embodiments and applications which may constitute applications of the principles of the invention. These above-described embodiments are provided to teach the present best mode of the invention only, and should not be interpreted to limit the scope of the claims. Such other embodiments, may use somewhat different steps and routines which may be readily devised by those skilled in the art without departing from the spirit or scope of this invention and it is our intent that they are deemed to be within the scope of this invention.

The invention claimed is:

1. A hot wax dispenser, comprising:

(A) a heat conductor;

(B) a grate located below said heat conductor;

(C) a bulk heating bowl attached below said grate;

(D) a cup located below said bulk heating bowl;

(E) an insert located in said cup; and (F) a first heating element attached to said heat conductor for melting wax and wherein said melted wax can flow from the wax placed on said grate, through said grate, into said bulk heating bowl and when released into said insert in said cup.

2. A hot wax dispenser, as recited in claim 1, wherein said heat conductor is selected from the group consisting of a heat conducting plate placed in proximity to wax for melting and a heat conducting plate and a plurality of spring clips adapted to hold a wax container in place.

3. A hot wax dispenser, as recited in claim 1, wherein said heat conductor is made of heat conducting metal.

4. A hot wax dispenser, as recited in claim 1, further comprising a body mechanically attached to said heat conductor, said grate and said bulk heating bowl and wherein said body further comprises a base, a front body portion, a rear portion and a base portion.

5. A hot wax dispenser, as recited in claim 1, further comprises a valve attached to said bulk heating bowl to control the flow of melted wax.

6. A hot wax dispenser, as recited in claim 5, further comprising a handle in mechanical communication with said valve.

7. A hot wax dispenser, as recited in claim 1, further comprising a cup handle in mechanical communication with said cup.

8. A hot wax dispenser, as recited in claim 1, further comprising a second heating element attached to said bulk heating bowl.

9. A hot wax dispenser, as recited in claim 1, further comprising a third heating element attached to a cup plate in thermal communication with said cup.

10. A hot wax dispenser, as recited in claim 1, further comprising a knob in communication with one or more of said first, second or third heating elements.

11. A hot wax dispenser, as recited in claim 4, further comprising a lid located above said wax retainer, wherein said lid is pivotally attached to said rear portion of said body.

12. A hot wax dispenser, as recited in claim 1, further comprising a thermostatic switch in electronic communication with one or more of said first, second or third heating elements, for providing a thermal shut-off to one or more of said first, second or third heating elements.

13. A hot wax dispenser, as recited in claim 1, wherein said bulk heating bowl is not accessible.

14. A hot wax dispenser, as recited in claim 7, wherein said cup handle provides slidable access to said insert and said cup.

15. A hot wax dispenser, as recited in claim 1, further comprising an electric power connection to said first heating element.

16. A hot wax dispenser, as recited in claim 1, further comprising a base cover, attached to a base extension and a plurality of feet attached to said base cover.

* * * * *